US005678738A

United States Patent [19]

Licari

[11] Patent Number: 5,678,738

[45] Date of Patent: Oct. 21, 1997

[54] PLASTIC CLIP

[76] Inventor: Vito Licari, 875 Ocean Ave., Elberon, N.J. 07740

[21] Appl. No.: 507,089

[22] Filed: Jul. 26, 1995

[51] Int. Cl.[6] ..... A41H 43/00; A41F 1/00

[52] U.S. Cl. ..... 223/1; 223/DIG. 2; 24/543

[58] Field of Search ..... 24/543; 223/DIG. 2, 223/1

[56] References Cited

U.S. PATENT DOCUMENTS

| | | | |
|---|---|---|---|
| 2,551,019 | 5/1951 | Pierre | 24/543 |
| 4,214,686 | 7/1980 | Dostourian | 24/543 |
| 4,429,852 | 2/1984 | Tersteegen | 24/543 |
| 4,453,295 | 6/1984 | Laszczower | 24/543 |
| 4,742,601 | 5/1988 | Furutsu | 24/543 |
| 5,428,871 | 7/1995 | Iosif | 24/543 |

*Primary Examiner*—Bibhu Mohanty
*Attorney, Agent, or Firm*—Morton Chirnomas

[57] ABSTRACT

A plastic clip constructed in accordance with the present invention comprises an elongated frame portion. The elongated frame portion includes a guide channel having a closed end and an open end. The closed end is located at a position proximal to a first end of the frame portion and the open end is located at the opposite end of the guide channel from the closed end. The frame portion further includes channel a blocking portion for blocking the open end of the guide channel. The blocking portion comprises a looking tab attached to the frame portion adjacent to the open end of the guide channel. The blocking means further comprises tab engaging portion for releasably receiving and securing the looking tab. The arrangement thereby permits a plurality of similar articles to be clipped by inserting them onto the guide channel and securing them there by closing engaging the blocking portion.

6 Claims, 3 Drawing Sheets

PLASTIC CLIP

FIELD OF THE INVENTION

The present invention relates generally to a method for clipping together articles for sale as well as the clip for doing so. More particularly, the present invention relates to a method for clipping together plastic housewares such as clothing hangers for retail sale as well as an apparatus for so doing, the design of the method and the structure of the apparatus lending themselves to easy automation of the packaging process from the injection molding machine to the shipping case.

BACKGROUND OF THE INVENTION

Manufacturers of practically all consumer products which are sold to the general consuming public have to consider how to package their product. Among the aspects of the packaging which requires consideration is that of how easy the packaging is for handling by the particular distributor, retail chain or discount outlet which is usually the direct customer of the manufacturer. Additionally, the sturdiness of the packaging should be commensurate with the estimated abuse the package will receive before the consumer finally takes the product home. It does not do for a package intended to hold a multiple of the same product together to fall apart or for some of the product to fall loose before reaching the cash register.

In the case of tubular plastic hangers such as those disclosed in U.S. Design Pat. No. D330,635 to Licari, manufacturers have employed a variety of methods for holding together a multi-pack of the hangers. The most prevalent of these methods is to produce a paper or cardboard sleeve which is placed over and/or around a predetermined number of the hangers (frequently 3, 8 or 10 hangers per pack) and is then closed thereon using some form of adhesive such as adhesive tape or a spot of glue.

However, this method suffers from a number of disadvantages. Perhaps the most notable disadvantage of using the cardboard sleeve is that the sleeve is not usually able to withstand a good deal of handling before it tears and the hangers begin to fall out. In many cases, the hangers will fall out even without the sleeve becoming damaged. To overcome this problem, some manufacturers have resorted to providing shipping cases which are adapted to be display cases at the point of sale, thereby minimizing handling of the product by shop employees. However, the shipping case is not very attractive and relying on the shipping case forces stores to place the cases in valuable floor space or shelf space rather than simply displaying the hangers on rods, hooks or in racks.

Another disadvantage of relying on cardboard or paper sleeves for packaging multi-pack hangers and other plastic articles is that the sleeves must usually be purchased from an outside source. The cost of the sleeves may be affected by the number of sleeves ordered, the ever-rising cost of paper stock, increased costs of printing, etc. As with other outside-sourced components of any product, the availability of sleeves may be uncertain, affected by such regular calamities as trucking strikes, severe weather conditions, and from simply having a low priority on the sleeve producer's manufacturing schedule.

Because the cost of sleeves is usually tied to the number of sleeves ordered and because there is usually some lead-time which must be factored in, hanger manufacturers must usually purchase sleeves in rather large quantities and earlier than actually necessary to avoid being caught short trying to fill rush orders. As a result of having to lay in a good stock of inventory, it is not uncommon for a hanger manufacturer to get caught holding a large inventory of useless sleeves due to his customers desire for a different size multi-pack, e.g., a five hanger multi-pack rather than an eight-hanger multi-pack. Additionally, if the manufacturer discontinues a particular style of hanger and wants to introduce a new style, requiring a different sleeve, he is stuck either holding the obsolete labels or being forced to continue producing the obsolete hanger and perhaps having to sell it as a close-out at a reduced price until his sleeve inventory is used up. Because the plastic hanger industry is so crowded, there is relatively little profit margin to be found and all of the above disadvantages simply reduce that profit margin even further.

A further disadvantage of using wood pulp-derived sleeves relates to the additional strain which their use places on the world's wood pulp resources.

As disclosed hereinabove, there is often an extremely low profit margin, and sometimes even a loss, associated with producing plastic hangers in particular, and many injection molded plastic articles in general. Financial benefits gains are therefore sought by manufacturer's in areas of increased efficiency and automation wherever possible. In light of the manufacturer's desire to automate his packaging process wherever possible, it becomes an evident disadvantage to hanger manufacturers that the sleeves are not readily amenable to automation. By automation, it is meant that the hangers are automatically removed from the injection molding machine, by robot instead of by human hand as is conventionally done, oriented so that they are all aligned parallel with one another, bound together in multi-packs and inserted into shipping cases which are sealed.

OBJECTS AND SUMMARY OF THE INVENTION

It is therefore one object of the present invention to provide plastic housewares manufacturers with an inexpensive clip for clipping together multiples of molded plastic product.

It is another object of the invention to provide plastic housewares manufacturers with an inexpensive clip for clipping together multiples of molded plastic product which does not obscure the customer's view of the product.

It is still another object of the present invention to provide plastic housewares manufacturers with an inexpensive clip for clipping together multiples of molded plastic product which will withstand the abuse of customers at the retail level.

It is yet another object of the present invention to provide plastic housewares manufacturers with an inexpensive clip for clipping together multiples of molded plastic product which does not rely on wood natural resources.

It is a further object of the present invention to provide plastic housewares manufacturers with an inexpensive clip for clipping together multiples of molded plastic product which the manufacturer can mold himself, reducing dependence on outside suppliers.

It is still a further object of the present invention to provide plastic housewares manufacturers with an inexpensive clip for clipping together multiples of molded plastic product which reduces risk of being stuck with useless paper stock inventory.

It is yet a further object of the present invention to provide plastic housewares manufacturers with an inexpensive clip for clipping together multiples of molded plastic product which allows for easy automation of the packaging process from molding machine to shipping crate.

These objects and others not specifically enumerated hereinabove are achieved by the present invention which comprises a plastic clip having an elongated frame portion. The elongated frame portion includes a guide channel having a closed end and an open end. The closed end is located at a position proximal to a first end of the frame portion and the open end is located at the opposite end of the guide channel from the closed end. The frame portion further includes channel blocking means for blocking the open end of the guide channel. The blocking means comprises a locking tab attached to the frame portion adjacent to the open end of the guide channel. The blocking means further comprises tab engaging means for releasably receiving and securing the locking tab. The arrangement thereby permits a plurality of similar articles to be clipped by inserting them onto the guide channel and securing them there by closing engaging the blocking means. The guide channel is provided with an H-shaped cross-section.

The locking tab is attached to the frame portion at a position adjacent to the open end, with the locking tab being movable from a first open position whereby the open end of the channel guide is unblocked to a second closed position whereby the open end of the channel guide is blocked by the tab. The tab engaging means comprises cooperative engaging means on the locking tab and the frame portion adjacent to the open end of the guide channel. The cooperative engaging means in one exemplary embodiment comprises opposing barbed extensions attached to the frame portion adjacent to the open end of the guide channel such that the locking tab is releasably locked between the barbed extensions upon moving the locking tab from the first open position to the second closed position.

In another exemplary embodiment, the cooperative tab engaging means comprises upwardly directed bead extensions attached to the frame portion. Additionally, bead receiving apertures are provided in the locking tab. The bead receiving apertures are positioned to correspond with and releasably receive the bead extensions upon moving the locking tab from the first open position to the second closed position.

In another exemplary embodiment, the locking tab has receiving pockets to releasably receive the barbed extensions thereby maintaining the locking tab in the second closed position.

Where it is desirable to have a plurality of articles clipped together, a spacing member parallel to the guide channel and equal in length thereto is provided in the frame portion to reduce the movement of the clipped articles, thereby reducing stress on the tab engaging means.

BRIEF DESCRIPTION OF THE DRAWINGS

For a more complete understanding of the present invention, reference is made to the following description of one exemplary embodiment considered in conjunction with the accompanying figures of the drawings, in which.

DETAILED DESCRIPTION OF THE EXEMPLARY EMBODIMENTS

Figure 1:
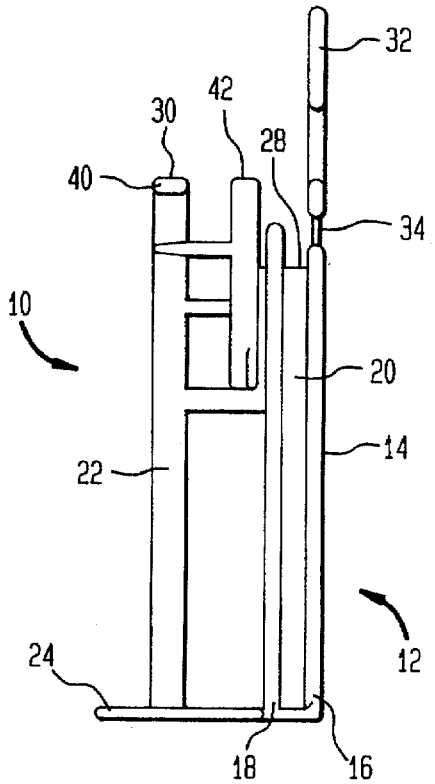
FIG. 1 is a front elevational view of one exemplary embodiment of a hanger clip constructed in accordance with the present invention, with the clip in an open, unengaged positioned.
Figure 2:
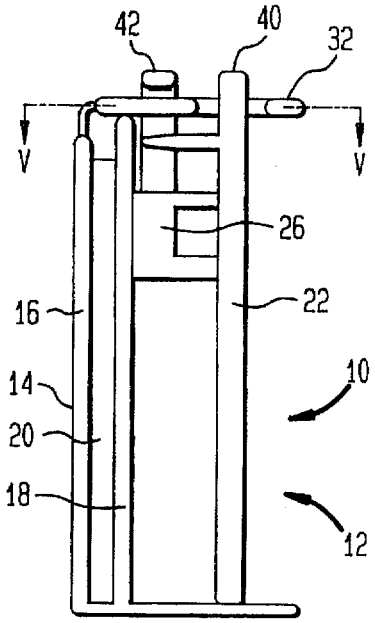
FIG. 2 is a rear elevational view of the hanger clip shown in FIG. 1 with the clip in a closed, engaged positioned.
Figure 3:
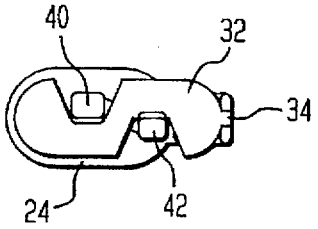
FIG. 3 is a top plan view of the hanger clip shown in FIG. 2 with the clip in a closed, engaged position.
Figure 4:
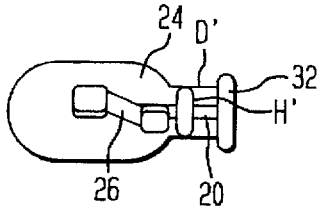
FIG. 4 is a top plan view of the hanger clip as shown in FIG. 1 with the clip in an opened, unengaged position.
Figure 5:
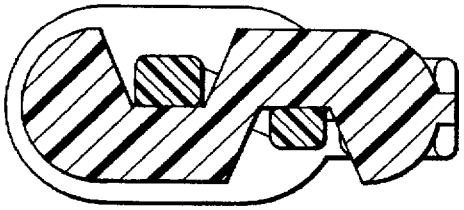
FIG. 5 is a cross-sectional view, taken along line V—V in FIG. 2 and looking in the direction of the arrows.

In the following discussion of the exemplary embodiments, like parts of different embodiments will be referenced by numerals which are the same but increased by or the like. Referring now to FIGS. 1–8, an exemplary embodiment of a clip 10 is preferably made from a resilient plastic such as polyethylene, polypropylene, polypropylene co-polymer, or rubberized polypropylene. The use of these resilient materials provide an inexpensively produced clip which is still up to the abuse that a product within the retail environment may be subjected to by the consumer.

The clip 10 constructed in accordance with the present invention comprises a longitudinal frame portion 12 having along one longitudinal side thereof guide channel 14 formed between two parallel channel walls 16 and 18. Channel walls 16 and 18 are connected to one another and maintained in an equidistant relationship by crossmember 20 extending therebetween. Spacing member 22 is located a determined distance from and in a substantially parallel relationship to guide channel 14, that distance being determined by the size and conformation of the gap provided in the articles to be clipped together as will be further explained hereinbelow. One end of spacing member 22 and one end of guide channel 14 terminate at end wall 24 with which they are substantially perpendicular. Spacing member 22 and guide channel 14 are approximately the same length (that being approximately some whole number multiple of the thickness of the articles to be clipped together) and are further maintained in a substantially parallel orientation by bridge member 26. Bridge member 26 extends between channel 14 and spacing member 22 at some distance from end wall 24 and even as far as adjacent to or near their ends 28 and 30, respectively, opposite end wall 24.

A substantially planar locking tab 32 is coplanar and coextensive with channel wall 16 adjacent to end 28 of channel 14 to which it is attached. Locking tab is attached by flexible hinge portion 34. Locking tab 32 has an S-shape and is provided with opposing engagement surfaces 36 and 38 on the inside edges of the S. These are positioned to correspond and engage with opposing locking barbs 40 and 42 when locking tab 32 is inserted between locking barbs 40 and 42. Locking barbs 40 and 42 together with locking tab 32 comprise locking means which releasably engage one another to hold in place articles arranged in clip 10. Locking barb 40 is an extension of spacing member 22 and locking barb 42 projects upward from bridge member 26 to a position substantially parallel with locking barb 40. Locking barbs 40 and 42 extend upward a sufficient distance such that locking tab 32 is at an elevation directly below that of the barbs 40 and 42 when bent over at a right angle with channel walls 16 and 18 and spacing member 22. Locking tab 32 is engaged by bending it over in a downwardly direction until engaging surfaces 36 and 38 are resting between barbs 40 and 42. Then downward force is applied against locking tab 32 until it slides down past barbs 40 and 42 which resiliently spread in response to the force and then close back over locking tab 32 and against engaging surfaces 36 and 38, thereby preventing locking tab 32 from rising up into its unengaged position.

Figure 6:
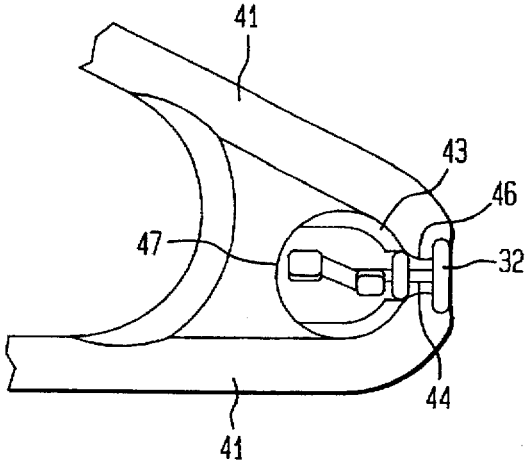
FIG. 6 is an elevational view of a portion of a tubular clothes hanger having a clip constructed in accordance with the present invention inserted therein in an unengaged position.
Figure 7:
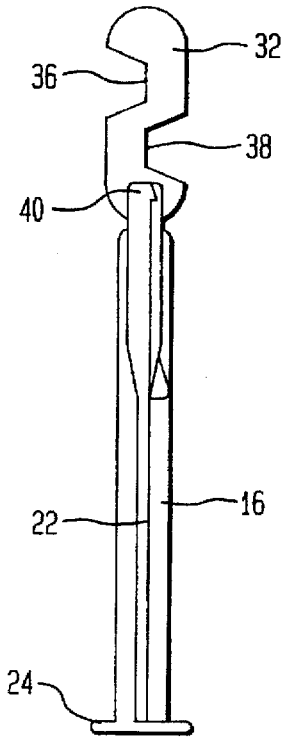
FIG. 7 is a left side elevational view of the hanger clip shown in FIG. 1.
Figure 8:
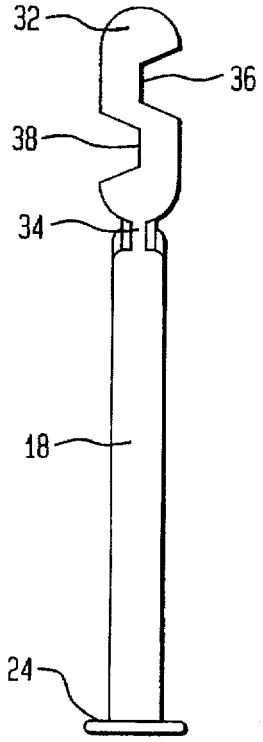
FIG. 8 is a right side elevational view of the hanger clip shown in FIG. 1.

The clip 10 is designed to engage a plurality of articles, such as tubular hangers, which have some portion or which have been modified to provide a gapped or indented portion. This could be done by manufacturing the product with a permanent structural gap or indentation or by providing a snap-away region which can be easily removed by the consumer at home. With reference to FIG. 6, the tubular clothes hanger 41 shown has as part of its design an indented portion 43 which presents a gap 44, designed to receive skirt straps, neck ties, belt buckles and the like. The gap 44 in this particular instance spans a distance of roughly 3 mm–4 mm across. Crossmember 20 of guide channel 14 has a thickness slightly less than gap 44. The height H' of channel walls 16 and 18 as well as the distance D' between them (the width of crossmember 20) are determined based on the thickness or radius of the article being clipped in the vicinity of the gap portion. H' should be slightly larger than gap 44, or more than 4 mm in the example given. D' must be sufficiently large so that channel walls 16 and 18 are on opposite sides of the gap's centerline and yet preferably not actually pressing forcefully against the article's gap ends 46. Although some pressure or friction between channel walls 16 and 18 and the articles being clipped is not necessarily undesirable.

Spacing member 22 is provided to reduce the angular slippage around the guide channel 14 of articles clipped together thereon. Reduction of angular motion reduces the torsional stress to which the engaged locking tab 32 is subjected by a bundle of clipped articles, thereby lessening the possibility that the locking tab 32 could pop open unintentionally. Therefore, as shown in FIG. 6, the distance from the outer edge of spacing member 22 to channel guide 14 should be similar to the distance from gap ends 46 to an opposite side 47 of indented portion 43. By so doing, even a single hanger placed onto clip 10 by inserting guide channel 14 through gap 44 could not swing back and forth on clip 10 any more than the arc which brings indented portion 43 into contact with spacing member 22. This immobilization facilitates automation of hanger packaging by automatically positioning within defined parameters the position of a hanger placed onto a clip 10. This reliability of positioning is required for use of a robot for [1] removing hangers from a molding machine, [2] placing them on clips 10, [3] and closing the clips and putting the hangers in a shipping case.

Figure 9:
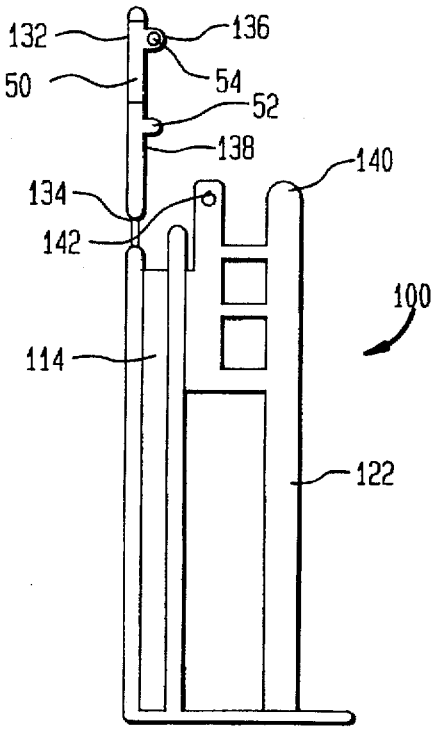
FIG. 9 is a front elevational view of another exemplary embodiment of a hanger clip constructed in accordance with the present invention, with the clip in an open, unengaged positioned.
Figure 11:
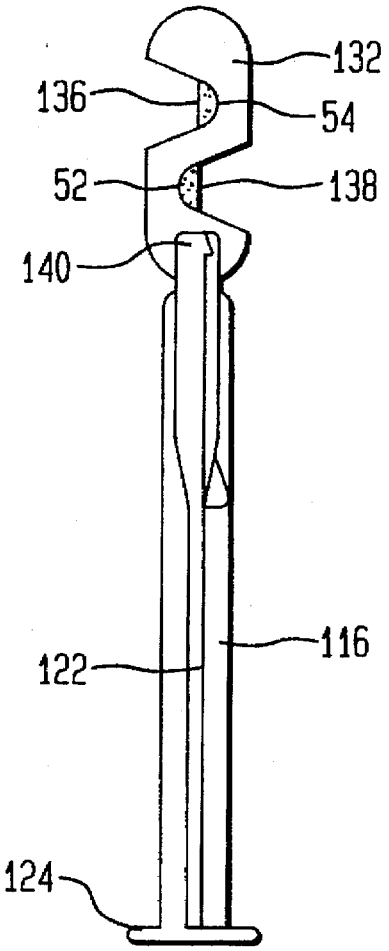
FIG. 11 is a right side elevational view of the hanger clip shown in FIG. 9.

Referring now to FIGS. 9 and 11, one embodiment of a hanger clip 100 has an S-shaped locking tab 132 which includes modified engagement surfaces 136 and 138. Each engagement surface 136 and 138 is provided with a side projection 50 and 52, respectively. Side projections 50 and 52 are provided with receiving pockets 54 and 56, respectively, formed in the surface thereof. Locking barbs 140 and 142 extend upwardly from spacing member 122 and bridge member 126, respectively, a distance such that locking barbs 140 and 142 engage and are firmly seated in the corresponding receiving pocket when locking tab 132 is rotated around hinge 134 until it is perpendicular to guide channel 114 and forcibly seated therebetween.

Figure 10:
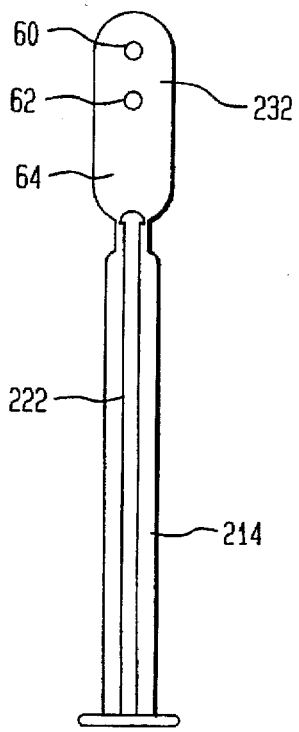
FIG. 10 is a left side elevational view of another exemplary embodiment of a hanger clip constructed in accordance with the present invention, with the clip in an open, unengaged positioned.

Referring now to FIG. 10, locking tab 232 has a simple planar ovoid conformation. The center of locking tab 232 is provided with receiving holes 60 and 62 positioned to correspond with locking beads 64. Locking beads 64 are substantially hemispherical, frusto-conical, pyramidal, frusto-pyramidal or semi-ovoid shaped terminal ends extending upwardly from spacing member 222 and bridge member (not visible), respectively. Locking beads 64 have a slightly larger cross-sectional area at their widest points than that of receiving holes 60 and 62. Thus when locking tab 232 is rotated down and over locking beads 64 into a position substantially perpendicular to guide channel 214, receiving holes 60 and 62 are pressed down past the thickest portion of locking beads 64. Receiving holes 60 and 62 are only temporarily deformed by passing over the wider locking beads 64 due to the resiliency of the materials employed for forming the clip of the invention. Upon the restoration of receiving holes 60 and 62 to their original size, the locking tab 232 can no longer be easily removed from locking beads 64 and 66.

Ideally, the clip 210 of the invention can be molded at exactly the same time as the articles which it will bind together, indeed from the same injection mold. In that way, the clip 232 can be applied to the articles and locked as described hereinabove. This allows the receiving holes 60 and 62 to be deformed while the plastic is still warm and retains a great deal of elastic memory. As the plastic cools, it causes some shrinking and the subsequent contraction causes the locking mechanism to be extremely reliable and far less likely to come apart with only minimal effort.

Figure 12:
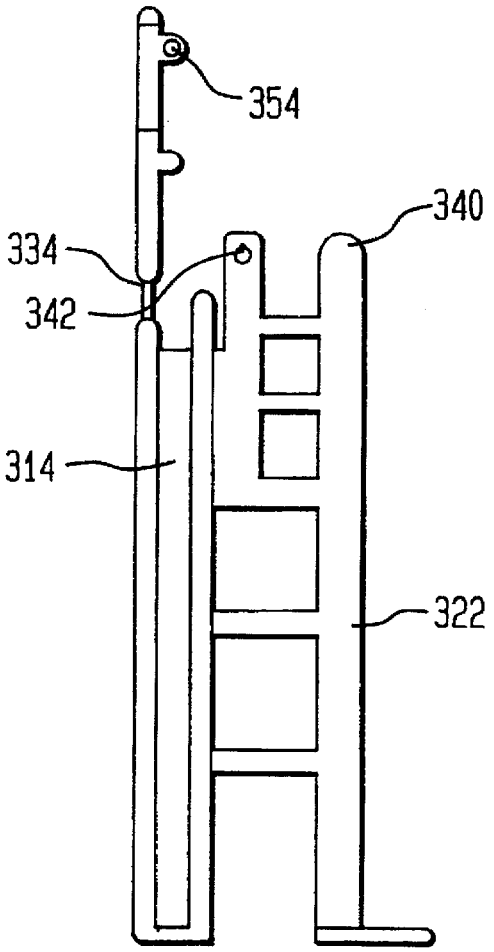
FIG. 12 is a front elevational view of another exemplary embodiment of a plastic clip constructed in accordance with the present invention.
Figure 13:
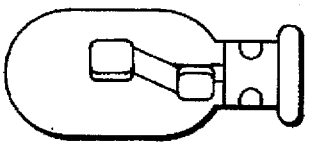
FIG. 13 is a top plan view of another exemplary embodiment of a plastic clip constructed in accordance with the present invention.

FIGS. 12 and 13 show an embodiment of a clip 310 having a frame 312 comprising fewer solid body portions. For example, instead of having continuous end wall 24 connecting spacing member 22 with channel guide 14, there are provided more intermediary frame cross-members. Additionally, channel guide 314 does not quite have an H-shaped cross-section. Rather, the cross-section is more U-shaped. In fact, it is anticipated that a large number of cross-sectional conformations are compatible with the present invention under the appropriate circumstances. Generally speaking, as long as a channel guide 314 and gap 44 of the articles to be clipped together correspond in a lock-and-key fit, then the invention is practicable with that channel guide cross-sectional conformation.

It will be understood that the embodiments described herein are merely exemplary and that a person skilled in the art may make many variations and modifications without departing from the scope and spirit of the invention. All such modifications and variations are intended to be included within the scope of the invention as defined in the appended claims.

I claim:

1. A plastic clip comprising an elongated frame portion, said elongated frame portion including a guide channel with a fixed distance between the walls, said guide channel having a closed end and an open end, said closed end being at a position proximal to a first end of said frame portion and said open end being at the opposite end of said guide channel from said closed end, said frame portion further including channel blocking means for blocking said open end of said guide channel, said blocking means comprising a locking tab attached to said frame portion by a hinge at a position adjacent to said open end of said guide channel and further comprising tab engaging means for releasably receiving and securing said locking tab, said locking tab being movable about said hinge from a first open position wherein said open end of said channel guide is unblocked to a second closed position wherein said locking tab is received between said tab engaging means such that open end of said channel guide is blocked by said locking tab, whereby a plurality of similar articles inserted onto said guide channel may be securely clipped together.

2. A plastic clip in accordance with claim 1, said tab engaging means comprising cooperative engaging means on said locking tab and on said frame portion adjacent to said open end of said guide channel.

3. A plastic clip in accordance with claim 2, said tab engaging means comprising opposing barbed extensions extending upwardly from said frame portion adjacent to said open end of said guide channel such that said locking tab is releasably locked between said barbed extensions upon moving said locking tab from said first open position to said second closed position.

4. A plastic clip in accordance with claim 2, said tab engaging means comprising upwardly directed beads extensions attached to said frame portion and further comprising bead receiving apertures in said locking tab, said bead receiving apertures being positioned to correspond with and releasably receive said bead extensions upon moving said locking tab from said first open position to said second closed position.

5. A plastic clip in accordance with claim 3, wherein said locking tab has at least one receiving pocket to releasably receive said barbed extensions thereby securely maintaining said locking tab in said second closed position.

6. A plastic clip in accordance with claim 1, further comprising a spacing member parallel to said guide channel.

* * * * *